US005589036A

United States Patent [19]

Fleck

[11] Patent Number: 5,589,036

[45] Date of Patent: Dec. 31, 1996

[54] CONTROLLING PULP FLOW IN AN UPFLOW PULP TREATMENT TOWER

[75] Inventor: John A. Fleck, West Chester, Ohio

[73] Assignee: Champion International Corporation, Stamford, Conn.

[21] Appl. No.: 115,110

[22] Filed: Sep. 2, 1993

Related U.S. Application Data

[63] Continuation of Ser. No. 884,947, May 18, 1992, abandoned.

[51] Int. Cl.[6] ..... D21C 7/06

[52] U.S. Cl. ..... 162/246; 162/243

[58] Field of Search ..... 162/246, 17, 243

[56] References Cited

U.S. PATENT DOCUMENTS

| | | | |
|---|---|---|---|
| 1,776,761 | 9/1930 | Morterud | 162/246 |
| 1,813,205 | 7/1931 | Scholz et al. | 162/246 |
| 1,915,812 | 6/1933 | Wollenburg | 162/17 |
| 2,078,810 | 4/1937 | Richter | 162/246 |
| 2,166,200 | 7/1939 | Thorne | 162/243 |
| 2,198,709 | 4/1940 | Tomlinson | 162/246 |
| 2,769,710 | 11/1956 | Becker | 162/17 |
| 2,772,864 | 12/1956 | Rich | 162/246 |
| 3,053,067 | 9/1962 | Frykhult | 162/246 |
| 3,237,773 | 3/1966 | Laakso | 162/246 |
| 3,301,027 | 1/1967 | Rich | 162/246 |
| 3,313,678 | 4/1967 | Rydin | 162/19 |
| 3,622,441 | 11/1971 | Perkins | 162/246 |
| 3,700,548 | 10/1972 | Rich | 162/17 |
| 3,787,284 | 1/1974 | Richter | 162/246 |
| 3,881,986 | 5/1975 | Backlund | 162/246 |
| 4,120,748 | 10/1978 | Zucker | 162/248 |
| 5,397,434 | 3/1995 | Costa et al. | 162/4 |

*Primary Examiner*—Brenda A. Lamb

[57] ABSTRACT

The flow patterns of the wood/paper pulp in a paper pulp treatment tower are controlled to provide for even flow through and discharge of the pulp from the upper end of the tower. Flow-altering fluids are injected into the pulp stock in the tower via appropriately positioned nozzles which create flow-altering fluid streams in the pulp stock. The streams are operable to produce either an inwardly directed pulp flow, or an outwardly directed pulp flow, whichever is desired. The system results in smooth, relatively even movement of the pulp stock from the bottom of the tower to the top, so that each fraction of the pulp mass will spend substantially the same dwell time in the tower, whereby the pulp mass is evenly processed and reacted in the tower. The resultant treated stock is superior to pulp stock treated in a tower without such flow controls.

1 Claim, 3 Drawing Sheets

CONTROLLING PULP FLOW IN AN UPFLOW PULP TREATMENT TOWER

This is a continuation of application Ser. No. 07/884,947 filed May 18, 1992 now abandoned.

TECHNICAL FIELD

This invention relates to improvements in paper pulping technology, and more particularly to a pulp treatment tower flow control system and method which results in higher quality, more evenly reacted pulp discharge.

BACKGROUND ART

In the manufacture of commercial paper, wood pulp is chemically treated to prepare it for further processing steps. Such pulping treatment and processing is typically performed in pulp treatment towers. The raw or partially treated wood pulp and chemical mixture will conventionally be fed into one end of the tower and migrate to the other end while being treated with such chemicals as bleaches, acids, bases and the like, so as to modify the color and fiber chemical and physical characteristics and consistency of the pulp to produce a product suitable for paper formation. One type of pulp treatment tower that is widely used is a tower wherein the raw or partly treated wood pulp is fed into the bottom of the tower and migrates therein to the top of the tower, where it is withdrawn for further processing. U.S. Pat. No. 5,015,335, granted May 14, 1991 to C. E. Green is a pulp stock bleach tower that operates in an upflow manner, the pulp and bleach mixture being fed into the lower end of the tower and discharged from the upper end thereof.

In the ideal bottom-to-top pulp treatment tower, the pulp will continuously flow in an even stream from the entry point to the discharge point, so that every aliquot of pulp in the discharge stream will have spent substantially the same amount of time in the tower, and will have been treated or chemically altered to the same extent. Thus, the ideal pulp treatment tower would produce a homogeneously treated discharge stream. In reality, however, pulp stock flowing through an upflow pulp treatment tower does not necessarily display even and steady flow characteristics. The pulp will often flow through the tower along faster and slower moving paths, with the pulp stock located adjacent the tower perimeter moving very slowly, and with the pulp stock located more inwardly of the tower frequently flowing along faster moving channels, much like a river, wherein the water at the banks will typically move more slowly than the water in the middle of the stream. The aforesaid pulp channels will also frequently meander from the inlet to the outlet of the tower. The resultant pulp discharge will therefore consist of fractions which have resided in the tower for longer periods of time than other fractions. Even when such a heterogeneous mixture is blended, the result is a product which is not as desirable as a homogeneously treated mixture. Scrapers may be installed in the top of the pulp treatment tower to mechanically control pulp flow and move the pulp stream toward the discharge pipes of the tower, but such scrapers are expensive and difficult to install in existing towers, and are generally operable to create only a tangential discharge flow pattern in the top of the tower. Such scrapers may not help in controlling pulp flow in lower portions of the tower.

DISCLOSURE OF INVENTION

This invention relates to an upflow pulp treatment tower assembly, and a method of operating the same which produces a more even, controlled flow of pulp from the tower inlet to the tower discharge. The result is a more homogeneously treated pulp discharged from the tower. The flow control employed in this invention can be used to create a controlled flow pattern to a central discharge point, or a controlled flow pattern to one or more peripheral discharge points. The flow control system of the invention utilizes a plurality of fluid jet nozzles which discharge discrete streams of a diluent fluid into the pulp stock. These jet streams both dilute the consistency of the pulp stock and at the same time create the desired flow pattern in the tower. The result is a less viscous, controlled flow of pulp.

One embodiment of a pulp treatment tower which employs the flow control technology of this invention has a conical upper end portion which directs the pulp to a central discharge port. Preferably, the central discharge port will open into a discharge pipe, however the discharge port can also form an open spillway which discharges the pulp onto an annular collection trough on the exterior of the tower. The collection trough will empty into a vertical collection tube. This embodiment of the pulp treatment tower uses central axial pulp flow control patterns which are produced by diluent fluid injection nozzles which inject flow-altering jets of fluid into the pulp. The injected jets of fluid create pulp flow streams inside of the tower which are directed toward the vertical axis of the tower. A combination of injection nozzles will preferably be utilized. The nozzles will inject the diluent fluid along one or more of the following flow paths: tangentially of the tower (as the tower is viewed in plan); radially of the tower; axially of the tower; along chordal flow paths; and also, perpendicularly of the conical upper end portion of the tower. This combination of injection fluid flow paths will create an inwardly swirling diluted pulp flow stream in the tower which is directed toward the central discharge port. This flow pattern will prevent or minimize pulp flow stagnation which tends to occur at the outer edges of the pulp mass. It also minimizes the formation of localized pulp flow channels in the pulp stock. If an outwardly swirling pulp flow pattern is desired, a centralized conical baffle will be disposed inside of the tower in the upper portion thereof. In this embodiment, the axial injection nozzles will open into the tower through the baffle, and the rest of the nozzles will open into the tower through the cylindrical sidewall of the tower. The pulp flow will thus be initially directed against the baffle where the flow will be deflected outwardly toward the sidewall of the tower to spill over the top edge of the tower sidewall into the collection trough. If desired, a sequential inward-outward-inward flow pattern to a central discharge port can be created by using the injection nozzles as described above, along with the conical baffle and the frustoconical top end wall on the tower.

It is therefore an object of this invention to provide an improved wood/paper pulp treatment technique wherein an upflow pulp treatment tower is modified to produce a controlled and even flow of the pulp in the tower.

It is an additional object of this invention to provide a pulp treatment technique of the character described wherein pulp aliquot dwell time in the tower is substantially equal to produce a homogeneously treated discharge pulp.

It is a further object of this invention to provide a pulp treatment technique of the character described wherein diluent fluids are injected into the pulp treatment tower to create a swirling pulp stock flow pattern in the tower.

It is another object of this invention to provide a pulp treatment technique of the character described wherein the pulp stock is diluted to a lowered consistency and directed along an inwardly or outwardly swirling flow path toward a discharge port in the top of the tower.

These and other objects and advantages of the invention will become more readily apparent from the following detailed descriptions of several embodiments of the invention when taken in conjunction with the accompanying drawings, in which:

BEST MODE FOR CARRYING OUT THE INVENTION

Figure 1:
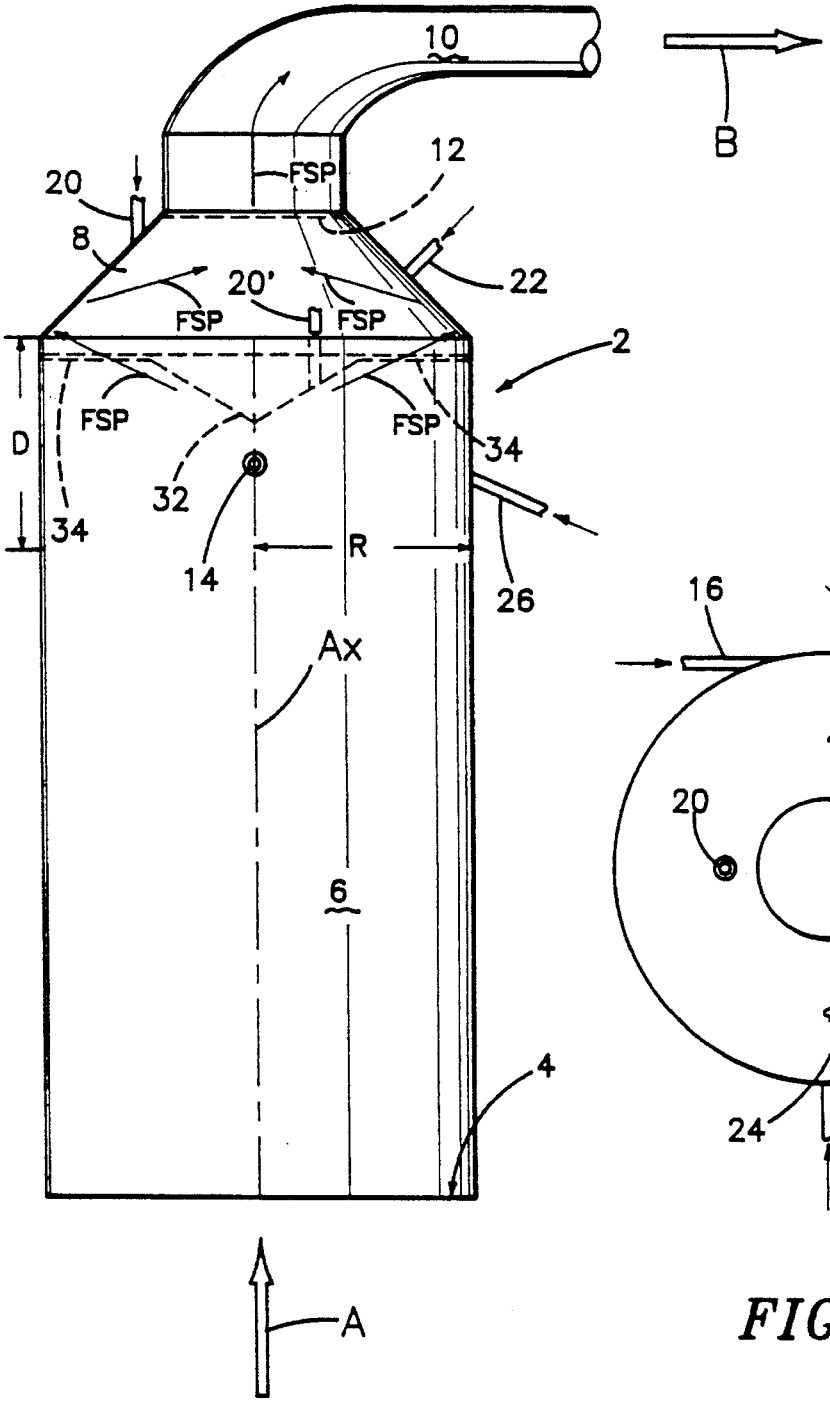
FIG. 1 is a schematic elevational representation of a cylindrical upflow pulp treatment tower having a central top discharge port which tower includes pulp flow control injection nozzles operating in accordance with this invention.

Referring now to the drawings, FIG. 1 is a somewhat schematic representation of a pulp treatment tower, which tower is denoted generally by the numeral 2. The tower 2 has a lower end 4, cylindrical sidewall 6, and a frustoconical top wall 8. A discharge conduit 10 may be disposed at the top of the wall 8 for routing treated pulp out of the top of the tower 2. As previously noted, the tower 2 is an upflow tower in that the raw or partially treated pulp/chemical mixture enters the tower 2 at the lower end thereof 4, as indicated generally by the arrow A and migrates through the tower 2 to the upper end thereof. If so desired, the discharge conduit 10 may be omitted, and the treated pulp stock may exit the tower 2 via an opening 12 (shown in phantom) and flow thence down the outer surface of the top wall 8 to a collection trough (not shown in FIG. 1), as will be described in greater detail hereinafter. In either case, the treated pulp is discharged from the top of the tower 2 as indicated generally by the arrow B.

In order to control the passage of the pulp stock through the tower, a plurality of fluid injection nozzles are disposed on the tower 2, which nozzles receive a fluid under pressure from a source thereof through an injection fluid manifold system (the source and manifold not being shown), which pressurized fluid is injected into the pulp stock in the tower 2 through the nozzles. The injected fluid jets create controlled pulp flow streams in the pulp mass which establish the direction and velocity of pulp stock flow in the tower 2.

Figure 2:
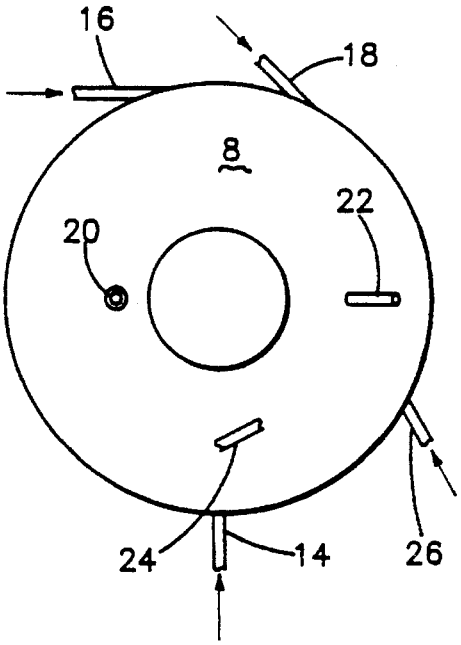
FIG. 2 is a schematic plan view of the tower of FIG. 1.
Figure 3:
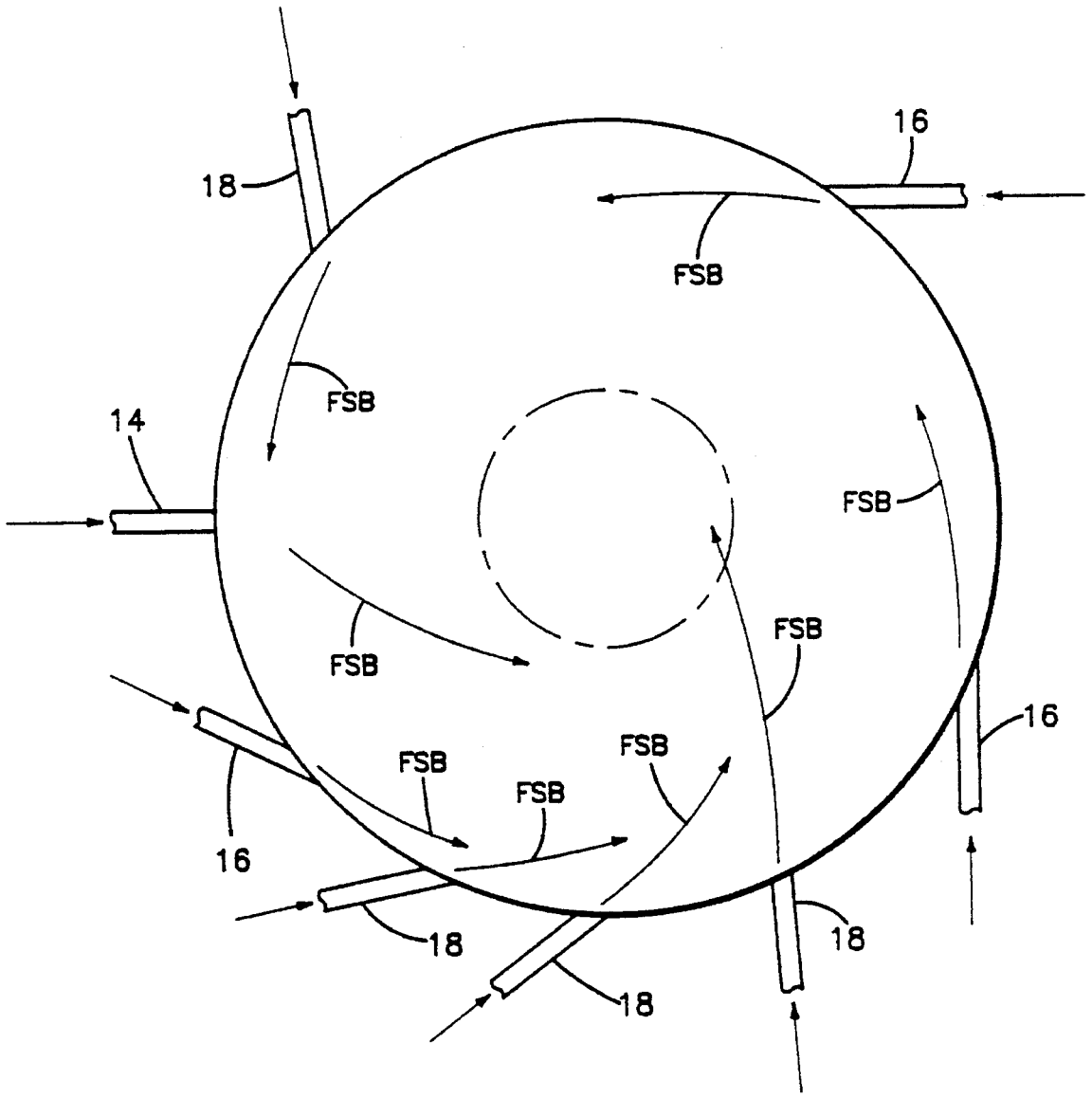
FIG. 3 is a schematic plan view of the tower of FIGS. 1 and 2 showing a pulp flow path created within the tower by the injection nozzles.

The nozzles may be oriented on the tower 2 in a number of different ways, as will be seen from FIGS. 1, 2 and 3. For example: nozzles 14 can inject fluid jets into the pulp stock along paths corresponding with the plan view radii of the tower 2; nozzles 16 can inject tangential fluid jets into the tower 2; and intermediately positioned nozzles 18 will inject fluid jets into the pulp mass along various chordal paths (viewing the tower 2 in plan) in the tower. In addition to the aforesaid plan view nozzle placements, as shown in FIGS. 1 and 2, axial jet nozzles 20 may be disposed in the tower top wall 8, as well as nozzles 22 which are aligned perpendicular to the top wall 8, and nozzles 24 which are skew to the tower top wall 8. Furthermore, nozzles 26 may be placed in the tower upper sidewall 6 which are inwardly angled and preferably upwardly angled relative to the vertical axis Ax of the tower 2. Nozzles 26 can be perpendicular to the vertical axis or even pointed down, but are preferred to be upwardly pointed.

The fluid jet nozzles, and the fluid, liquid or gas they inject into the pulp stock perform two basic functions, one is to create directional pulp stock flow stream paths inside of the tower; and the other is to dilute the consistency of the pulp stock when it is intermixed with the injected fluids. The pulp stock flow stream paths are identified patternwise by the arrows FSP in FIGS. 1, 3 and 4. FIG. 3 illustrates an inwardly directed pulp flow pattern for discharge of pulp via the discharge conduit 10 or via a central opening 12 in the tower 2. If pulp is discharged through an opening in the upper end of the tower 2, a trough 28 will be provided on the outside of the cylindrical part of the tower to gather the cascading pulp stream and direct it into a collection tube 30 which extends downwardly from the trough 28 along the outside surface of the tower 2.

Figure 4:
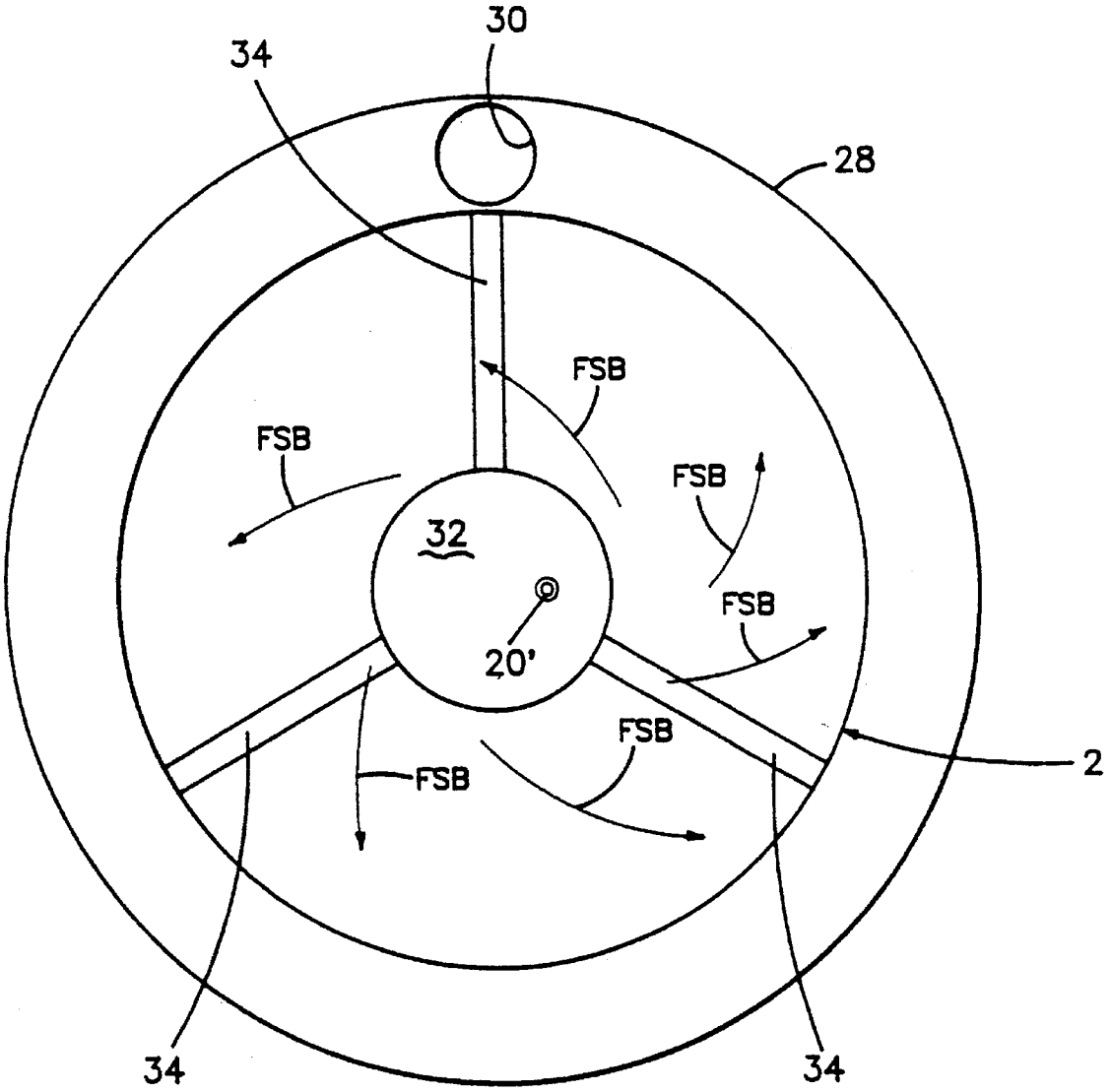
FIG. 4 is a view similar to FIG. 3 but showing an alternate pulp flow path created within the tower.

FIGS. 1 and 4 illustrate details of an embodiment of the invention which achieves a radially outwardly directed flow stream of the pulp in the upper portion of the tower 2. This embodiment uses the nozzles 14, 16 and 18, as shown in FIGS. 2 and 3, although they are not shown in FIG. 4 for simplicity of illustration. In the outward flow stream embodiment, the conical top wall 8 of the tower 2 is not employed, and the top end of the tower 2 is simply open. A conical baffle and flow diverter 32 is disposed in an upper part of the tower 2 below the open end thereof, with its apex facing downwardly. The baffle 32 is mounted in the tower 2 by means of struts 34 secured to the inside of the tower wall. One or more axial nozzles 20' may inject fluid streams axially into the pulp stock through the baffle 32. The nozzles 14, 16, 18 and 20' operate as previously described to create an inwardly and upwardly swirling flowing stream of diluted pulp which is directed against the conical baffle 32 in the upper central part of the tower 2. The baffle then deflects the pulp stream outwardly and upwardly toward the top rim of the tower 2, where the pulp overflows into the trough 28.

As shown in FIG. 1, a combined embodiment which features an inward-outward-inward pulp flow pattern that can be realized when the baffle 32 is included in the embodiment of the tower which utilizes the frustoconical top wall 8 and the central discharge conduit 10. In this combined embodiment, the inward swirling flow pattern is created by the nozzles 14, 16, 18 and 20, and the succeeding outward flow pattern results from the baffle 32. The pulp stream from the baffle then encounters the inside of the frustoconical top wall 8 which deflects the pulp stream back upwardly and inwardly toward the discharge conduit 10, as illustrated by the arrows FSP in FIG. 1.

In certain cases, it may be useful to pulse the nozzles so as to break up slowly flowing pulp masses near the tower wall. In such instances, simple flow control valves would be used to increase and/or decrease diluent fluid from the sequenced ones of the nozzles.

The nozzles 14, 16 and 18 can be placed anywhere on the cylindrical sidewall of the tower 2 below the bottom edge of the top wall 8; however preferably, the nozzles 14, 16 and 18 should be spaced apart from the top wall 8 a distance D (see FIG. 1) which is no greater than the radius R of the tower, and most preferably, no greater than R/2. The nozzles 20 and 22 in the top wall 8 should be spaced apart from the tower sidewall a distance equal to no more than 2/3R, and preferably in the range of R/4 to R/3. Adjacent nozzles 14, 16 and 18 should be spaced apart by an included angle (in plan) in the range of about 20°–30°, and on the top wall 8, the included angle between adjacent nozzles is preferably 20°.

The fluids which are injected into the pulp stock through the nozzles can be: filtrate from a successive thickening stage; water, bleaching chemicals such as chlorine, chlorine dioxide, hypochlorite, sodium hydroxide, peroxide, oxygen, ozone, nitrogen oxide, or safe mixtures of the aforesaid; and gaseous forms of the aforesaid chemicals and compounds; and air and nitrogen either in combination with the aforesaid chemicals and compounds or by themselves. When gaseous injection fluids are used, a gas/pulp mixture will form at the top of the tower and will provide an additional buoyant force for moving the pulp up and out of the tower.

The injected fluids, as noted above, in addition to creating pulp flow streams in the tower, serve to dilute the consistency of the injected pulp, thereby increasing the flowability of the pulp at the top of the tower. For example, dilutions of 12% consistency pulp to a range of 1–10% consistency are achievable, with the narrower range of about 2–6% being preferable. A likely diluted pulp consistency is about 4%. To achieve a 4% consistency, 2.0 lbs. of water would be added for every 1.0 lb. of 12% consistency pulp in the injected zone of the tower. When using gaseous chemicals and compounds, up to 30% by volume may be added to the pulp. The preferred range of gas addition for pulp movement is 2 to 10% by volume with less sometimes required for only chemical treatment of the pulp by a gaseous chemical. Other consistency pulps can also be diluted and controlled using this invention.

It will be readily appreciated that upflow of pulp stock in a pulp treatment tower can be controlled both flowpathwise and timewise by using the system and method of this invention. The result is the production of a more homogeneously treated, higher quality pulp discharged from the tower with minimal additional equipment. Existent upflow towers can be retrofitted with the necessary nozzles and manifolds or hoses needed to convert to a mode of operation envisioned by this invention. New upflow towers can be designed to incorporate this invention.

Since many changes and variations of the disclosed embodiments of the invention may be made without departing from the inventive concept, it is not intended to limit the invention otherwise than as required by the appended claims.

What is claimed is:

1. A method for controlling movement of pulp stock in an upflow cylindrical pulp treatment tower, said method comprising the steps of:

(a) injecting jets of a diluent fluid into said tower through a side wall thereof, said jets moving along flow paths which vary from tangential of said tower in one or more first jets, to radial of said tower in one or more second jets;

(b) vectoring pulp flow streams resulting from said diluent jets with said tower toward a restricted discharge zone from said tower, which the discharge zone has a smaller area than the cross-sectional area of said tower wherein said pulp flow streams are initially converged toward the tower axis, subsequently deflected toward the tower circumference and reconverged toward the tower axis after said subsequent deflection step; and (c) discharging said vectored pulp flow stream from said tower.

* * * * *